US007301419B2

(12) United States Patent
Mizuno et al.

(10) Patent No.: US 7,301,419 B2
(45) Date of Patent: Nov. 27, 2007

(54) FILTERING TYPE FREQUENCY SWITCHING CIRCUIT

(75) Inventors: Kazuo Mizuno, Nagoya (JP); Ryu Kimura, Chita-gun (JP); Hisanori Uda, Nagoya (JP); Hiroaki Hayashi, Nagoya (JP)

(73) Assignee: DENSO Corporation, Kariya (JP)

( * ) Notice: Subject to any disclaimer, the term of this patent is extended or adjusted under 35 U.S.C. 154(b) by 230 days.

(21) Appl. No.: 10/545,365

(22) PCT Filed: Apr. 16, 2004

(86) PCT No.: PCT/JP2004/005513

§ 371 (c)(1),
(2), (4) Date: Aug. 11, 2005

(87) PCT Pub. No.: WO2004/093237

PCT Pub. Date: Oct. 28, 2004

(65) Prior Publication Data

US 2006/0192630 A1 Aug. 31, 2006

(30) Foreign Application Priority Data

Apr. 17, 2003 (JP) ..... 2003-112448

(51) Int. Cl.
*H01P 1/10* (2006.01)
*H01P 5/12* (2006.01)

(52) U.S. Cl. ..... 333/101; 333/103

(58) Field of Classification Search ..... 333/101, 333/103, 104, 105, 107, 26, 164
See application file for complete search history.

(56) References Cited

U.S. PATENT DOCUMENTS 4,125,810 A * 11/1978 Pavio ..... 455/327

(Continued)

FOREIGN PATENT DOCUMENTS

JP 60-94501 A 5/1985

(Continued)

OTHER PUBLICATIONS

Examination Report from corresponding JP application No. 2003-112448.

(Continued)

*Primary Examiner*—Dean Takaoka
(74) *Attorney, Agent, or Firm*—Harness, Dickey & Pierce, PLC

(57) ABSTRACT

Two lines Ai1 (i=1 or 2) are connected to an input terminal In. The line $A_{i1}$ is grounded via a capacitor $C_{i1}$. The line $A_{i1}$ and a line $B_{i1}$ form a coupled line. One end of the line $B_{i1}$ is connected to a positive pole of a diode $D_{i1}$ which is grounded at its negative pole. Lines $B_{i0}$ and $B_{i2}$ are connected to the other end of the line $B_{i1}$. The other end of the line $B_{i0}$ is connected to a capacitor $C_{i0}$ which is grounded at its other end and a resistor $R_{i0}$ which is connected to a voltage control terminal $V_{CTLi}$ at its other end. The other end of the line $B_{i2}$ is connected to the positive pole of a diode $D_{i2}$. The line $B_{i2}$ and the line $A_{i2}$ form a coupled line. One end of the line $A_{i2}$ is connected to an output terminal Out-i, and the other end is grounded via a capacitor $C_{i2}$. The output of the terminals Out-1, 2 are switched to 5.8 GHz band, 4.8 GHz band and cut-off, by applying to $V_{CTL1}$ and $V_{CTL2}$ three potentials, that is, ground potential. positive potential which causes no current flow and positive potential which causes current flow.

13 Claims, 14 Drawing Sheets

U.S. PATENT DOCUMENTS

| | | | | |
|---|---|---|---|---|
| 4,224,572 | A * | 9/1980 | Will | 455/326 |
| 4,851,797 | A | 7/1989 | Nakamura | |
| 4,954,790 | A * | 9/1990 | Barber | 332/164 |
| 6,414,565 | B1 * | 7/2002 | Tanaka et al. | 333/81 A |
| 6,630,874 | B2 * | 10/2003 | Matsumoto et al. | 333/164 |
| 7,027,779 | B2 * | 4/2006 | Tai et al. | 455/83 |

FOREIGN PATENT DOCUMENTS

| | | | |
|---|---|---|---|
| JP | 64-74801 | A | 3/1989 |
| JP | 5-31325 | U | 4/1993 |
| JP | 9-83255 | A | 3/1997 |
| JP | 2002-217620 | A | 8/2002 |
| JP | 2003-124706 | A | 4/2003 |
| JP | 2003-179406 | A | 6/2003 |
| JP | 2003-224404 | A | 8/2003 |

OTHER PUBLICATIONS

Toshio Ishizaki, "Tri-plate Strip Line Filter", MWE 2000 Microwave Workshop Digest, [T4-3], pp. 461-468 (2000) (with English Abstract).

Kuniharu Takahashi, et al., "Filters for Microwave Satellite Communications Utilizing Multilayer PWB", Microwave and Satellite Communications Division, NEC Engineering, Ltd., NEC vol. 51, No. 4/1998, pp. 119-123 (with English abstract).

* cited by examiner freq (4.000GHz to 8.000GHz)

FILTERING TYPE FREQUENCY SWITCHING CIRCUIT

TECHNICAL FIELD

This invention relates to a filtering-type high frequency switching circuit. This invention is particularly useful for a filtering-type high frequency switching circuit having one input terminal and two output terminals.

BACKGROUND TECHNOLOGY

FIG. 8 is a circuit diagram showing the construction of a 1-input, 2-output high frequency switching circuit 900, which performs a switch function by applying different d.c. potentials to two diodes using quarter-wavelength lines. The high frequency switching circuit 900 has a switch circuit 91 between an input terminal In and an output terminal Out-1 and a switch circuit 92 between the input terminal In and an output terminal Out-2. The switch circuits 91 and 92 are constructed with devices having the same characteristics. Each switch circuit 9*i* (i being 1 or 2) has capacitors $C_{9i1}$ and $C_{9i2}$ at its ends for cut offing direct currents. These are connected by a quarter-wavelength line $SL_{9i}$. A positive or negative potential can be applied to the connection point between the quarter-wavelength line $SL_{9i}$ and the capacitor $C_{9i2}$ via a resistor $R_{9i}$, and the anode of a diode $D_{9i}$ is connected to the same connection point. The cathode of this diode $D_{9i}$ is grounded. Thus, for example, if a positive potential is applied to the anode of the diode $D_{91}$ via the resistor $R_{91}$ and a negative potential is applied to the anode of the diode $D_{92}$ via the resistor $R_{92}$, the switch circuit 91 turns off (acts as a cut off) because a current flows through the diode $D_{91}$ and the diode becomes conductive, and the switch circuit 92 turns on because a current does not flow to the diode $D_{92}$ and the diode becomes non-conductive. Thus, high frequency is not outputted to the output terminal Out-1 but band-filtered high frequency is outputted to the output terminal Out-2.

As relatively small band-pass filters made up of 2-port high frequency circuits, for example a 'Tri-Plate Strip Line Filter' (MWE2000 Microwave Workshop Digest, pp. 461-468 (2000)) and a 'Microwave Satellite Communications Filter Using Multi-Layer Printed Circuit Board' (NEC Technology Vol. 51 No. 4/1998, pp. 119-123) are generally known.

In the case of the 'Tri-Plate Strip Line Filter,' because it uses an LTCC (Low Temperature Co-Fired Ceramic), it must be mounted to another circuit board. Thus, its application to an organic substrate with a low dielectric constant is difficult. In particular, instability of quality due to variations in the thickness of the organic substrate becomes a problem. In the case of the 'Microwave Satellite Communications Filter Using Multi-Layer Printed Circuit Board' multiple quarter-wavelength lines are necessary, and the filter circuit necessarily becomes large. Also, when a switch is turned off by a diode being rendered conductive, because a current flows in the forward direction, a considerable amount of power is consumed. It is required to enlarge the range over which the input-output power characteristic is linear after the reverse bias is made a low potential, when a switch is turned on by a diode being turned off.

In this connection, the present inventors have invented and filed patent applications (Japanese Patent Application No. 2001-315243, Japanese Patent Application No. 2002-1910, Japanese Patent Application No. 2002-22689) for a filtering-type high frequency switching circuit having the construction shown in FIG. 9(*c*) as a typical construction. The construction of FIG. 9(*c*) will now be explained briefly.

FIG. 9(*a*) and FIG. 9(*b*) show circuits obtained by bisecting the circuit of FIG. 9(*c*), which is a circuit of a left-right symmetrical construction. In FIG. 9(*a*), an input/output terminal Port2 is provided and an inductance L is omitted. In FIG. 9(*b*), an input/output terminal Port2 is provided with an inductance L remaining. In FIG. 9(*b*), the inductance L can be replaced with a line without the following discussion being affected. In FIG. 9(*a*), a line A and a capacitor Ca are connected in series between a terminal Port1 and the ground. A line B and a capacitor Cb are connected in series between the terminal Port2 and the ground. Thus, the line A and the line B are coupled.

Now, the transmission characteristic from the terminal Portm to the terminal Portn in the circuit of FIG. 9(*a*) will be indicated as a complex number $S_{mn}$, whose absolute value is not greater than 1. That is, $S_{11}$ is the reflection characteristic of an input coming through the terminal Port1, and $S_{12}$ is the transmittance characteristic of an input coming through the terminal Port1 and outputted through the terminal Port2. In the circuit of FIG. 9(*a*), ideally the reflection characteristic from either terminal is 0. It is desirable that there is no attenuation from either terminal toward the other. That is, ideally, $S_{11}=S_{22}=0$ and $|S_{12}|=|S_{21}|=1$ hold. This relationship is a necessary condition for, in a filter circuit with the object of obtaining a signal having a desired frequency, transmitting that signal without reflecting it and without loss.

Here, a characteristic matrix S of which row m column n is $S_{mn}$ is considered. It is desirable to have the characteristic vector (1, 1) as an even excitation and the characteristic vector (1, −1) as an odd excitation. The characteristic value of the matrix S with respect to the even excitation characteristic vector (1, 1) will be represented by $\lambda_1$ and the characteristic value of the matrix S with respect to the odd excitation characteristic vector (1, −1) will be represented by $\lambda_2$. First, a matrix P made by writing the characteristic vector (1, 1) and the characteristic vector (1, −1) as vertical vectors can be expressed as shown in the following Exp. (1).

$$P = \frac{1}{\sqrt{2}}\begin{bmatrix} 1 & 1 \\ 1 & -1 \end{bmatrix} \tag{1}$$

Clearly, the matrix S can be developed as the following Exp. (2).

$$S = P\begin{bmatrix} \lambda_1 & 0 \\ 0 & \lambda_2 \end{bmatrix}P^{-1} = \frac{1}{2}\begin{bmatrix} \lambda_1+\lambda_2 & \lambda_1-\lambda_2 \\ \lambda_1-\lambda_2 & \lambda_1+\lambda_2 \end{bmatrix} \tag{2}$$

$S_{11}=S_{22=0}$, $|S_{12}|=|S_{21}|=1$ holds when the phases of the even excitation characteristic value $\lambda_1$ and the odd excitation characteristic value $\lambda_2$ are 180° apart. For example, $S_{11}=S_{22}=0$, $|S_{12}|=|S_{21}|=1$ holds when $\lambda_1=-\lambda_2=\pm\pm1$. However, $\lambda_1=-\lambda_2=1$ is the case of open in odd excitation and shorted in odd excitation, and shows a transmitting line, not a filter circuit. $\lambda_1=-\lambda_2=-1$ is the case of shorted in even excitation, open in odd excitation, and corresponds to a half-wave line and not, again, a filter circuit. Accordingly, for example $\lambda_1=-\lambda_2=\pm j$ becomes the design condition (phase condition) for a filter circuit. For $\lambda_1=\pm1$, $\pm j$, a correspondence on a Smith chart is shown in FIG. 10(*a*).

When a pair of coupled lines (line A and line B) is added as shown in FIG. 9(*a*), a signal can be inputted through the terminal Port1 and outputted through the terminal Port2. At the same time, because a signal from the terminal Port2 is transmitted slightly to the terminal Port1, the impedance seen from the terminal Port2 falls inside the Smith chart. This is shown in FIG. 10(*b*) as the result of a simulation. The graph shows the reflection characteristic of when the input signal is 4 GHz to 8 GHz, and the black dot positioned in the approximate center of the curve shows the reflection characteristic with respect to a 5.8 GHz input signal.

On the other hand, the time a symmetrical circuit transmits a signal efficiently is when conjugate matching (impedance matching) has been carried out at the plane of symmetry. Because the high frequency circuit being studied is left-right symmetrical, this condition means the reflection coefficient Sa being a real number. That is, the characteristic impedances seen to the right and the left from the point a in FIG. 9(*b*) should show forward resistance. So, as shown in FIG. 9(*b*), an inductance component L or a line is added near the plane of symmetry of the filter circuit. FIG. 10(*c*) is a Smith chart showing the effect on the reflection characteristic of the reflection coefficient Sa in the circuit (the left half of the filter circuit) of FIG. 9(*b*). In this way, by using the action of an inductance component to shift the reflection characteristic to the horizontal axis (real number axis) of the Smith chart, it is possible to achieve conjugate matching of the left-right symmetrical filter circuit at the plane of symmetry. That is, by this means, it is possible to make a band-pass filter with high transmission efficiency.

FIG. 12 is a Smith chart showing respective examples of a simulation result relating to a circuit (FIG. 11(*a*)) corresponding to even excitation of the circuit of this FIG. 9(*a*) and a simulation result relating to a circuit (FIG. 11(*b*)) corresponding to odd excitation.

The marker m3 (at the bottom) in FIG. 12 shows the reflection coefficient ($\lambda_1$) of the circuit at times of even excitation (FIG. 11(*a*)), and the marker m5 shows the reflection coefficient ($\lambda_2$) of the circuit at times of odd excitation (FIG. 11(*b*)). The frequency of the simulated input signal was 5.8 GHz in each case. In this way, the imaginary number components of the reflection coefficients of even excitation and odd excitation respectively become −j and j, and the symmetrical 2-port circuit of FIG. 9(*c*) fulfils the phase condition discussed above. That is, it can be seen that the symmetrical 2-port circuit of FIG. 9(*c*) can form a band-pass filter. When a band-pass filter having 5.8 GHz as its center frequency is actually simulated, the results shown in FIGS. 13(*a*) and 13(*b*) are obtained. With respect to the frequency 5.8 GHz, the attenuation is small, at $S_{21}$=−1.3 dB, the reflection is small, at $S_{11}$=−41.9 dB, and the high frequency is outputted well.

DISCLOSURE OF THE INVENTION

It is an object of the present invention to add new characteristics and improve the characteristics of a filtering function of a filtering-type high frequency switching circuit. It is another object of the invention to provide a filtering-type high frequency switching circuit having a switch that does not consume power when turned off. It is another object to provide a filtering-type high frequency switching circuit which makes it possible to enlarge the range of linearity of the input-output power characteristic at a low potential when a switch is turned on. A filtering-type high frequency switching circuit according to the invention can be ideally realized as a 1-input, 2-output (SPDT) filtering-type high frequency switching circuit having two switch circuits.

A filtering-type high frequency switching circuit provided by the invention has one input terminal, one output terminal, and a switch circuit between the input terminal and the output terminal. By the potential of at least one location in the switch circuit being made controllable, a high frequency of a desired bandwidth is passed or cut off. The switch circuit is made up of a first line having one end electrically connected to the input terminal and the other end connected to a first potential via a first capacitor, a second line forming a pair of coupled lines by being at least partly disposed substantially parallel to the first line and having one end connected to one end of a first diode having its other end connected to a second potential, a third line having one end connected to the other end of the second line and the other end connected to one end of a second diode having as its other end the same pole as the first diode connected to the second potential, a fourth line forming a pair of coupled lines by being at least partly disposed substantially parallel to the third line and having one end electrically connected to the output terminal and the other end connected to a third potential via a second capacitor, and a fifth line having one end connected to the connection point between the second line and the third line and the other end connected to a fourth potential. The first and second capacitors, the first and fourth lines, the second and third lines and the first and second diodes respectively have the same device characteristics. The switch circuit is symmetrical about the connection point between the second line, the third line and the fifth line, and at least one or the other of the second potential and the third potential is made the above-described controllable potential.

A diode can be made to operate as a capacitor if a current does not flow through it. Therefore, lines (the first and fourth lines) are connected to the input terminal and the output terminal, and two lines (the second and third lines) respectively coupled with these are connected in series. The same poles of two diodes are connected to the ends of the series connection of these latter two lines. The potential difference between the other poles (kept at the same potential) of the two diodes and the two lines between the two diodes is made controllable. That is, the potential of at least one or the other of the point of connection between the two lines and the poles of the diodes opposite from the sides thereof connected to the lines is made controllable. When the potential of only one of these is made controllable, the potential of the other is fixed. By this means, in the case of a reverse bias, under which no current flows through the diodes, or a forward bias such that the potential difference is small, the two diodes act as capacitors, and high frequency can be outputted to the output terminal from the input terminal through the first line, the second line coupled with the first line, the third line connected to the second line, and the fourth line coupled with the third line. At this time, by design of the first and second capacitors connected to the first and fourth lines, the switch circuit can be made to function as a band-pass filter from the input terminal to the output terminal. Its band can be set easily by suitable design of the lines, the capacitors and the diodes.

By combining two filtering-type high frequency switching circuits constructed as above, it is possible to make a 1-input, 2-output filtering-type high frequency switching circuit. That is, a 1-input, 2-output filtering-type high frequency switching circuit has one input terminal, two output terminals, and switch circuits each of the same construction between the input terminal and the two output terminals, and by the potential of at least one location in the switch circuit being made controllable in each of the two switch circuits, at least one of the switch circuits passes a high frequency of a desired bandwidth. Accordingly, when two switch circuits are provided like this, it is possible to make a filtering-type high frequency switching circuit function as a 1-input, 2-output band-pass filter.

Of the above two switch circuits, in one switch circuit the potential difference between the second potential and the third potential may be made 0 or a reverse bias while in the other the potential difference between the second potential and the third potential is made a forward potential difference in a range such that no current flows through the first and second diodes. When no current flows through the first and second diodes, changes in that potential difference become changes in capacitors formed by the diodes. By making the potential differences different in the two switch circuits, it is possible to make them function as band-pass filters having different bands.

Of the above two switch circuits, in one of the switch circuits the potential difference between the second potential and the third potential may be made a reverse bias and larger than the voltage amplitude of the high frequency wave inputted through the input terminal while in the other switch circuit the potential difference between the second potential and the third potential is made a forward potential difference in a range such that a current flows to the first and second diodes and made larger than the voltage amplitude of the high frequency wave inputted through the input terminal. By applying an ample reverse bias voltage to the diodes, it is possible to make distortion low even with respect to large high frequency inputs and to make large the dynamic range over which linearity can be maintained.

An open stub or a capacitor for shorting a second harmonic wave of the high frequency that is the center frequency of the band being passed and an open stub or a capacitor for similarly shorting a second harmonic wave may be provided at the point of connection of the second line, the third line and the fifth line. If open stubs or capacitors are connected so as to short out a second harmonic wave and a second harmonic wave, it is also possible to make large the dynamic range over which linearity can be maintained because distortion caused by the harmonic waves can be removed.

An inductor may be provided instead of the fifth line. The line between the voltage control point and the coupled lines can be replaced with an inductor, and both can easily be designed to have the same action.

It is possible to eliminate the fifth line, by connecting the third potential and one end of a capacitor to the point of connection between the second line and the third line and grounding the other end of the capacitor. In this way it is also possible to construct a filtering-type high frequency switching circuit performing the same function.

BEST MODE FOR CARRYING OUT THE EMBODIMENT

A number of embodiments of the invention will now be described with reference to specific circuit diagrams. The invention is not limited to these embodiments.

First Embodiment

Figure 1:
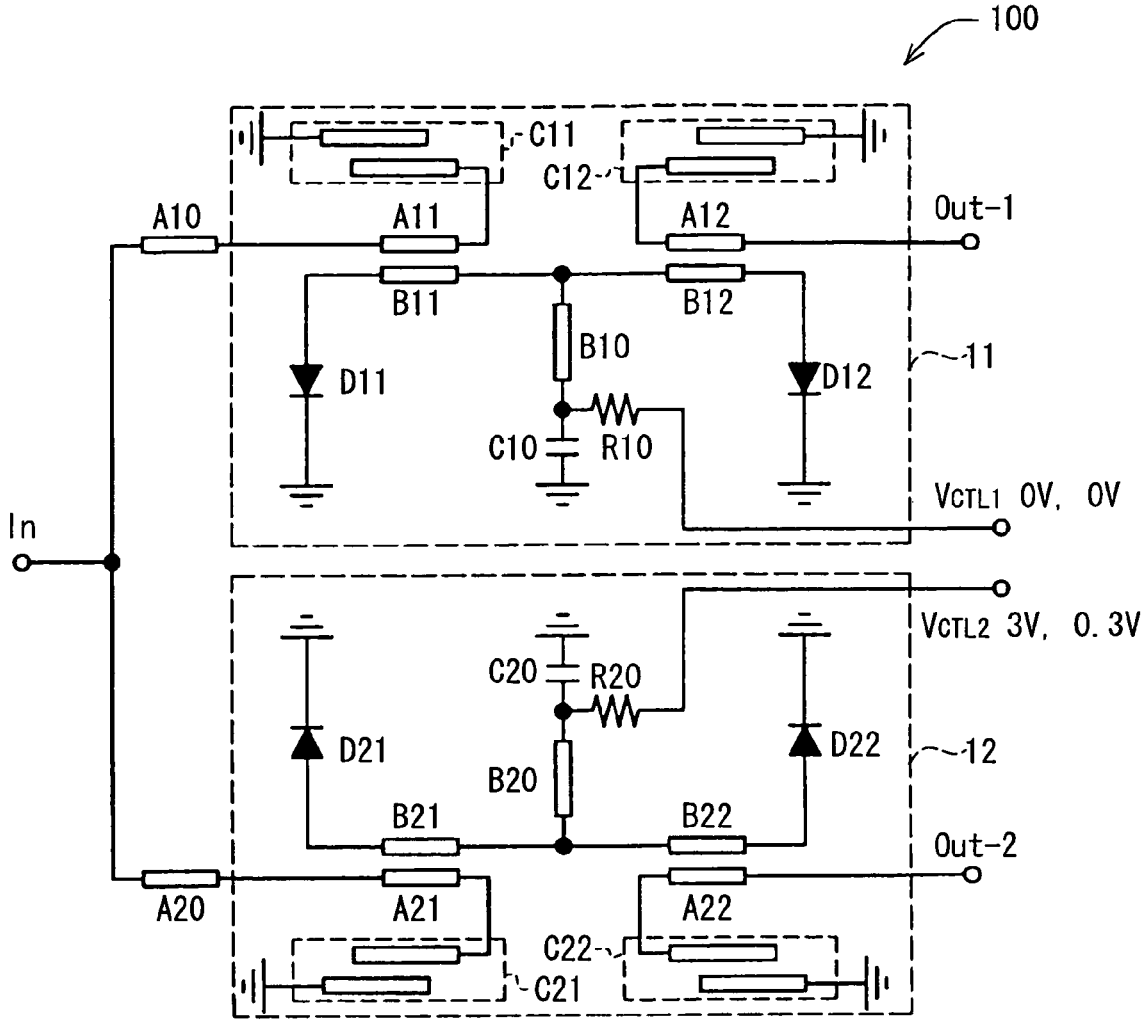
FIG. 1 is a circuit diagram showing the construction of a filtering-type high frequency switching circuit 100 according to a first embodiment of the invention.

FIG. 1 is a circuit diagram showing the construction of a filtering-type high frequency switching circuit 100 according to a first embodiment of the invention. The filtering-type high frequency switching circuit 100 has one input terminal In and two output terminals Out-1 and Out-2 and has two voltage control terminals $V_{CTL1}$ and $V_{CTL2}$.

Two lines $A_{10}$ and $A_{20}$ are connected to the input terminal In, and these have switch circuits 11 and 12 and the output terminals Out-1 and Out-2. The two switch circuits 11 and 12 each constitute a 1-input, 1-output switch with a filter function. They have exactly the same construction. The lines $A_{10}$ and $A_{20}$ are provided for characteristic adjustment, and in the first embodiment they are not essential constituent parts.

The construction of the switch circuit 1*i* between the line $A_{i0}$ and the output terminal Out-i (i=1 or 2) is as follows. On the opposite side of the line $A_{i0}$ from the input terminal In, a line $A_{i1}$ and a capacitor $C_{i1}$ are connected in series to ground. Although as the capacitor $C_{i1}$ a pair of coupled lines is shown in FIG. 1, it may alternatively be an ordinary capacitor. The line $A_{i1}$ forms a pair of coupled lines with a line $B_{i1}$. One end of the line $B_{i1}$ is connected to the anode of a diode $D_{i1}$, and the cathode of the diode $D_{i1}$ is grounded. A line $B_{i0}$ and a line $B_{i2}$ are connected to the other end of the line $B_{i1}$. A capacitor $C_{i0}$ and a resistor $R_{i0}$ are connected to the other end of the line $B_{i0}$, the other end of the capacitor $C_{i0}$ is connected to ground, and the other end of the resistor $R_{i0}$ is connected to the voltage control terminal $V_{CTLi}$. The other end of the line $B_{i2}$ is connected to the anode of a diode $D_{i2}$ and the cathode of the diode $D_{i2}$ is grounded. The line $B_{i2}$ forms a pair of coupled lines with a line $A_{i2}$. One end of the line $A_{i2}$ is connected to the output terminal Out-i, and a capacitor $C_{i2}$ is connected to the other end and grounded. Although as the capacitor $C_{i2}$ a pair of coupled lines is shown in FIG. 1, it may alternatively be an ordinary capacitor.

The device characteristics of the capacitor $C_{i1}$ and the capacitor $C_{i2}$, the line $A_{i1}$ and the line $A_{i2}$, the line $B_{i1}$ and the line $B_{i2}$ and the diode $D_{i1}$ and the diode $D_{i2}$ are respectively the same. The switch circuit 1*i* is a construction symmetrical on its input and output sides about the connection point of the line $B_{i1}$ and the line $B_{i2}$. The switch circuits 11 and 12 have exactly the same construction except that voltages can be applied independently to the voltage control terminals $V_{CTL1}$ and $V_{CTL2}$.

When the voltage control terminal $V_{CTLi}$ of the switch circuit 1*i* is grounded, no current flows through the diodes $D_{i1}$ and $D_{i2}$ and the diodes $D_{i1}$ and $D_{i2}$ both assume the same capacitor. The switch circuit 1*i* is designed as described above so that at this time it becomes a desired band-pass filter. That is, when the voltage control terminal $V_{CTLi}$ is grounded, a high frequency of a required band is outputted to the output terminal Out-i. When a positive voltage of a level such that a current flows through the diodes $D_{i1}$ and $D_{i2}$ is applied to the voltage control terminal $V_{CTLi}$, a high frequency is not supplied from the line $A_{i1}$ to the line $B_{i1}$, and a high frequency is not outputted to the output terminal Out-i. That is, when a sufficient positive voltage is applied to the voltage control terminal $V_{CTLi}$, no high frequency is outputted to the output terminal Out-i.

Figure 2:
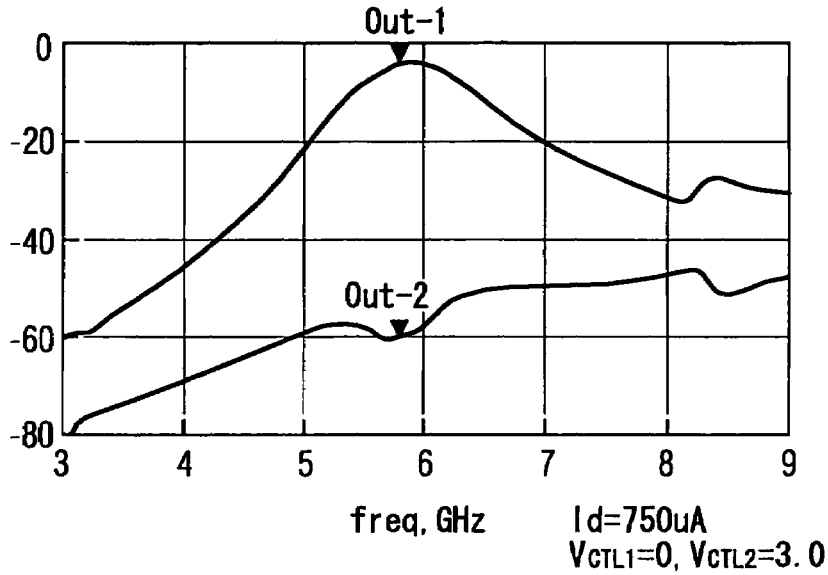
FIG. 2(*a*) is a frequency characteristic chart of when one output of the filtering-type high frequency switching circuit 100 is turned on and the other output is turned off, and FIG. 2(*b*) is a frequency characteristic chart of when the two outputs are made to be band-pass filter outputs of two different bands.
Figure 2:
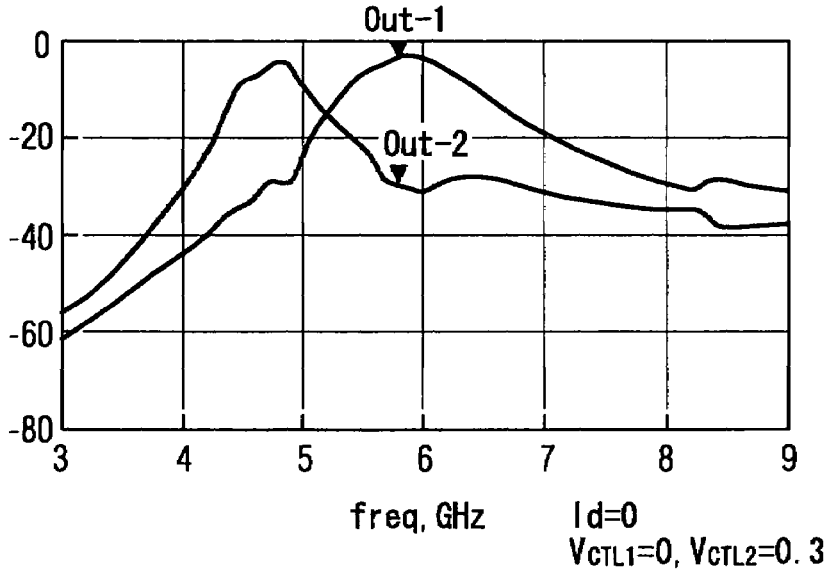

A simulation carried out in relation to this is shown in FIG. 2(*a*). In the simulation shown in FIG. 2(*a*), the switch circuits 11 and 12 are designed as band-pass filters having 5.8 GHz as their central frequencies, the voltage control terminal $V_{CTL1}$ is grounded (0V) so that the switch circuit 11 is thereby turned on (making it function as a band-pass filter), and 3V is applied to the voltage control terminal $V_{CTL2}$ so that the switch circuit 12 is thereby turned off (to cut off high frequencies). At this time, a current of 750 μA flowed to the diodes $D_{21}$ and $D_{22}$ of the switch circuit 12. FIG. 2(*a*) shows the relationship between the frequency of the high frequency inputted to the input terminal In and the outputs of the output terminals Out-1 and Out-2. As shown in FIG. 2(*a*), at the center frequency 5.8 GHz the attenuation from the output terminal Out-1 is extremely small, −2.9 dB, and high frequencies are outputted well. On the other hand, at the output terminal Out-2, the attenuation is extremely large, −59.6 dB, and high frequencies are cut off well. Thus, this filtering-type high frequency switching circuit 100 using diodes is extremely good as a 1-input, 2-output high frequency switching circuit with the filter function. In this example, there is no power consumption in the switch circuit 11.

(Variation)

In the filtering-type high frequency switching circuit 100 of FIG. 1, when a positive voltage of a level such that no current flows through the diodes $D_{i1}$ and $D_{i2}$ is applied to the voltage control terminal $V_{CTLi}$ of the switch circuit 1*i*, the diodes $D_{i1}$ and $D_{i2}$ work as capacitors. Because a potential is being applied, their capacitors at this time are different from their capacitors as of when no potential is being applied. To utilize this capacitor change, for the filtering-type high frequency switching circuit 100 having 5.8 GHz as its center frequency shown in FIG. 1, a simulation was carried out in which the voltage control terminal $V_{CTL1}$ was grounded (0V) and 0.3V was applied to the voltage control terminal $V_{CTL2}$, whereby the switch circuit 11 was turned on (making it function as a band-pass filter) and the capacitors of the diodes $D_{21}$ and $D_{22}$ of the switch circuit 12 were varied (to make it function as a band-pass filter of a different band). The results are shown in FIG. 2(*b*). In this case, no current flowed to the diodes $D_{11}$ and $D_{12}$ of the switch circuit 11 and no current flowed to the diodes $D_{21}$ and $D_{22}$ of the switch circuit 12 either.

FIG. 2(*b*) shows the relationship between the frequency of the high frequency inputted to the input terminal In and the outputs of the output terminals Out-1 and Out-2. As shown in FIG. 2(*b*), at the output terminal Out-1, at the center frequency 5.8 GHz the attenuation was extremely small, −2.9 dB, and high frequencies were outputted well. On the other hand, at the output terminal Out-2 the attenuation at the center frequency 5.8 GHz was extremely large, −29.6 dB, and high frequencies were cut off well.

At the center frequency of 4.8 GHz, conversely at the output terminal Out-1 the attenuation was extremely large and high frequencies were cut off well, and at the output terminal Out-2 the attenuation was extremely small and high frequencies were outputted well.

From the first embodiment and the variation thereof described above, the following can be easily deduced. That is, in the filtering-type high frequency switching circuit 100 of FIG. 1, by applying independently to the respective voltage control terminals $V_{CTL1}$ and $V_{CTL2}$ of the switch circuits 11 and 12 the three potentials that are ground potential, a potential such that a current does not flow, and a potential such that a current does flow, it is possible to produce from the respective output terminals the three outputs of for example a 5.8 GHz band filtered wave, a 4.8 GHz band filtered wave, and a cut off.

Second Embodiment

Figure 3:
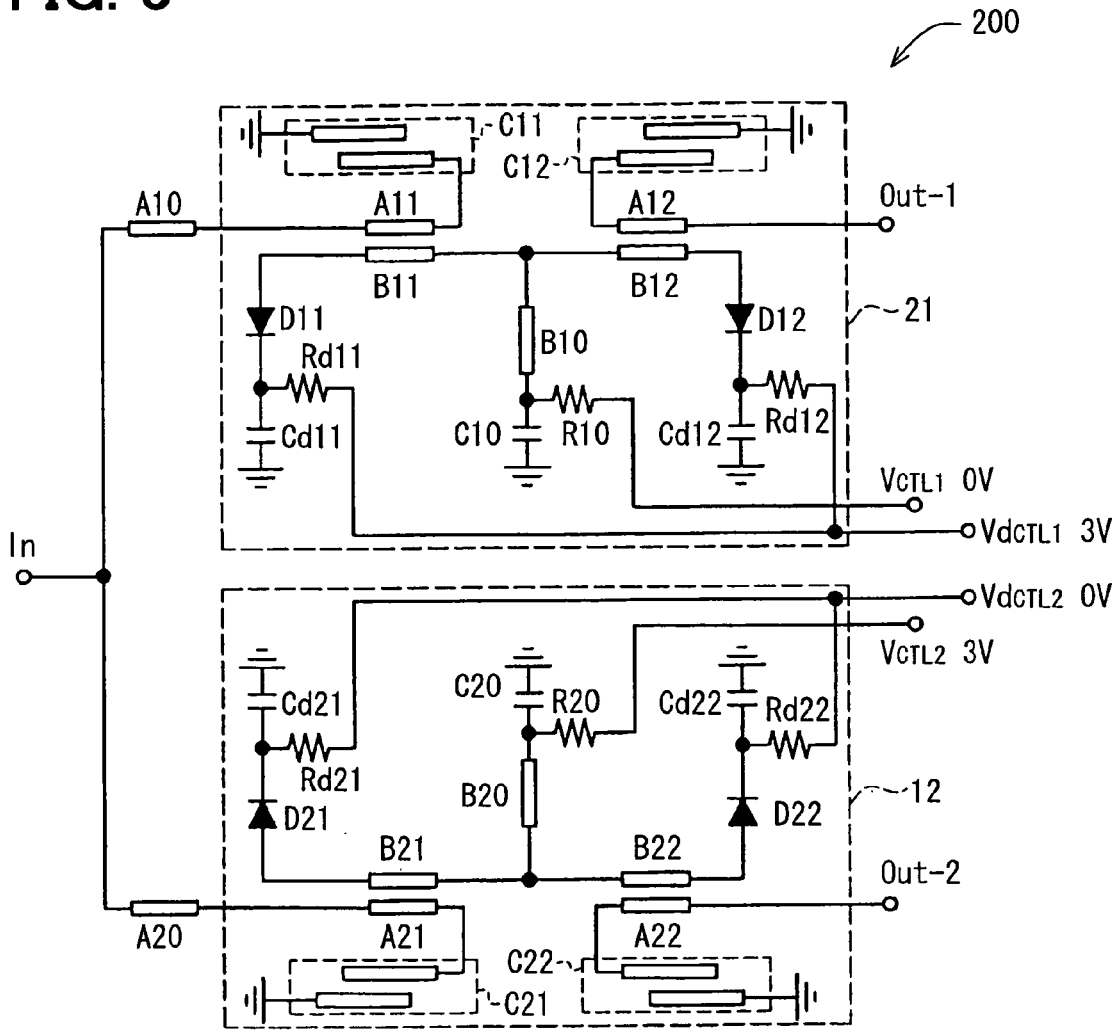
FIG. 3 is a circuit diagram showing the construction of a filtering-type high frequency switching circuit 200 according to a second embodiment of the invention.

FIG. 3 is a circuit diagram showing the construction of a filtering-type high frequency switching circuit 200 according to a second embodiment of the invention. The construction of the filtering-type high frequency switching circuit 200 of FIG. 3 is exactly the same as that of the filtering-type high frequency switching circuit 100 of FIG. 1 except for the parts discussed below, and the parts that are the same have been given the same reference numerals.

The filtering-type high frequency switching circuit 200 of FIG. 3 has, with respect to the filtering-type high frequency switching circuit 100 of FIG. 1, capacitors $Cd_{im}$ provided between the cathodes of the diodes $D_{im}$ (i and m are 1 or 2) and ground, resistors $Rd_{im}$ connected to the cathodes of the diodes $D_{im}$, and pull-up potentials $Vd_{CTLi}$ connected to the other ends of the resistors $Rd_{i1}$ and $Rd_{i2}$. The four capacitors $Cd_{im}$ all have exactly the same characteristics, and the four resistors $Rd_{im}$ also all have identical characteristics.

A filtering-type high frequency switching circuit provided by the invention has one input terminal, one output terminal, and a switch circuit between the input terminal and the output terminal. By the potential of at least one location in the switch circuit being made controllable, a high frequency of a desired bandwidth is passed or cut off. The switch circuit is made up of a first line having one end electrically connected to the input terminal and the other end connected to a first potential via a first capacitor, a second line forming a pair of coupled lines by being at least partly disposed substantially parallel to the first line and having one end connected to one end of a first diode having its other end connected to a second potential, a third line having one end connected to the other end of the second line and the other end connected to one end of a second diode having as its other end the same pole as the first diode connected to the second potential, a fourth line forming a pair of coupled lines by being at least partly disposed substantially parallel to the third line and having one end electrically connected to the output terminal and the other end connected to a third potential via a second capacitor, and a fifth line having one end connected to the connection point between the second line and the third line and the other end connected to a fourth potential. The first and second capacitors, the first and fourth lines, the second and third lines and the first and second diodes respectively have the same device characteristics. The switch circuit is symmetrical about the connection point between the second line, the third line and the fifth line, and at least one or the other of the second potential and the fourth potential is made the above-described controllable potential.

A diode can be made to operate as a capacitor if a current does not flow through it. So, lines (the first and fourth lines) are connected to the input terminal and the output terminal, and two lines (the second and third lines) respectively coupled with these are connected in series. The same poles of two diodes are connected to the ends of the series connection of these latter two lines, and the potential difference between the other poles (kept at the same potential) of the two diodes and the two lines between the two diodes is made controllable. That is, the potential of at least one or the other of the point of connection between the two lines and the poles of the diodes opposite from the sides thereof connected to the lines is made controllable. When the potential of only one of these is made controllable, the potential of the other is fixed. By this means, in the case of a reverse bias, under which no current flows through the diodes, or a forward bias such that the potential difference is small, the two diodes act as capacitors, and high frequency can be outputted to the output terminal from the input terminal through the first line, the second line coupled with the first line, the third line connected to the second line, and the fourth line coupled with the third line. At this time, by design of the first and second capacitors connected to the first and fourth lines, the switch circuit can be made to function as a band-pass filter from the input terminal to the output terminal. Its band can be set easily by suitable design of the lines, the capacitors and the diodes.

By combining two filtering-type high frequency switching circuits constructed as described above, it is possible to make a 1-input, 2-output filtering-type high frequency switching circuit. That is, a 1-input, 2-output filtering-type high frequency switching circuit has one input terminal, two output terminals, and switch circuits each of the same construction between the input terminal and the two output terminals, and by the potential of at least one location in the switch circuit being made controllable in each of the two switch circuits, at least one of the switch circuits passes a high frequency of a desired bandwidth. Accordingly, when two switch circuits are provided like this, it is possible to make a filtering-type high frequency switching circuit function as a 1-input, 2-output band-pass filter.

Of the two switch circuits described above, in one switch circuit the potential difference between the second potential and the third potential may be made 0 or a reverse bias while in the other the potential difference between the second potential and the third potential is made a forward potential difference in a range such that no current flows through the first and second diodes. When no current flows through the first and second diodes, changes in that potential difference become changes in capacitors formed by the diodes. By making the potential differences different in the two switch circuits, it is possible to make them function as band-pass filters having different bands.

Of the above-described two switch circuits, in one of the switch circuits the potential difference between the second potential and the third potential may be made a reverse bias and larger than the voltage amplitude of the high frequency wave inputted through the input terminal while in the other switch circuit the potential difference between the second potential and the third potential is made a forward potential difference in a range such that a current flows to the first and second diodes and made larger than the voltage amplitude of the high frequency wave inputted through the input terminal. By applying an ample reverse bias voltage to the diodes, it is possible to make distortion low even with respect to large high frequency inputs and to make large the dynamic range over which linearity can be maintained.

An open stub or a capacitor for shorting a second harmonic wave of the high frequency that is the center frequency of the band being passed and an open stub or a capacitor for similarly shorting a second harmonic wave may be provided at the point of connection of the second line, the third line and the fifth line. If open stubs or capacitors are connected so as to short out a second harmonic wave and a second harmonic wave, it is possible to make large the dynamic range over which linearity can be maintained because distortion caused by higher harmonics can be removed.

Further, an inductance may be provided instead of the fifth line. The line between the voltage control point and the coupled lines can be replaced with an inductor, and both can easily be designed to have the same action.

Also, it is possible to adopt a construction wherein the fifth line is dispensed with and the third potential and one end of a capacitor are connected to the point of connection between the second line and the third line and the other end of the capacitor is grounded. In this way also it is possible to construct a filtering-type high frequency switching circuit performing the same function.

Figure 4:
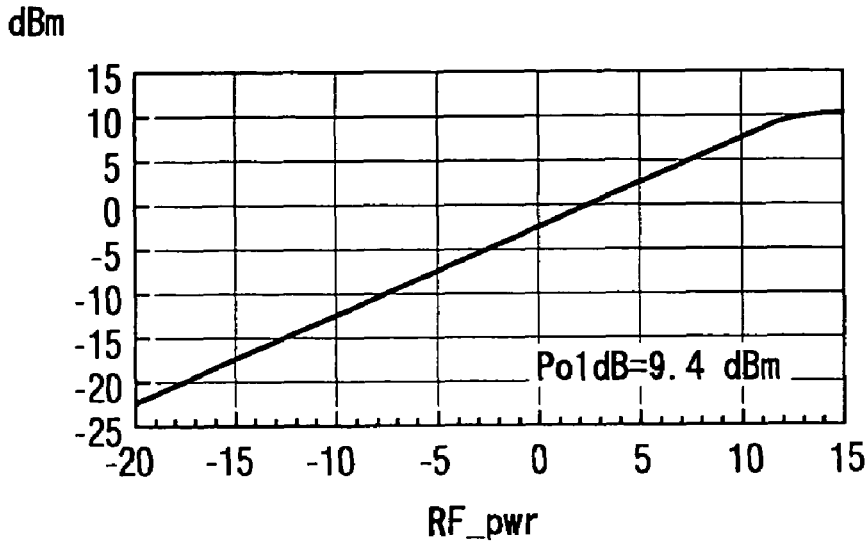
FIG. 4(*a*) is an output characteristic chart of the filtering-type high frequency switching circuit 200, and FIG. 4(*b*) is an output characteristic chart of the filtering-type high frequency switching circuit 100.
Figure 4:
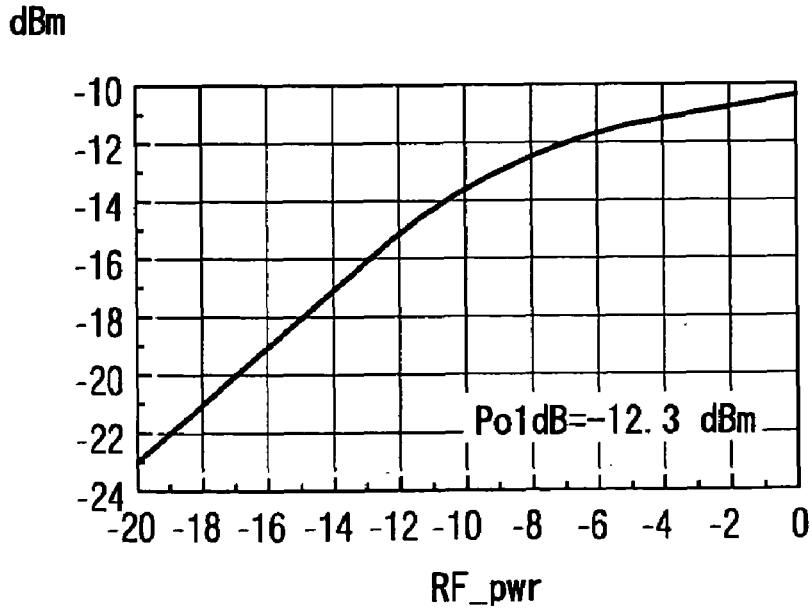

For the filtering-type high frequency switching circuit 200 of FIG. 3, the power characteristic of when the voltage control terminal $V_{CTL1}$ was grounded (0V) and 3V was applied to the voltage control terminal $V_{CTL2}$, whereby the switch circuit 11 was turned on (making it function as a band-pass filter) and the switch circuit 12 was turned off (to cut off high frequencies), and also 3V was applied as the pull-up potential $Vd_{CTL1}$ and the pull-up potential $Vd_{CTL2}$ was grounded (0V), is shown in FIG. 4(*a*). As an example for comparison, the power characteristic of when in the filtering-type high frequency switching circuit 100 of FIG. 1 the voltage control terminal $V_{CTL1}$ was grounded (0V) and 3V was applied to the voltage control terminal $V_{CTL2}$ is shown in FIG. 4(*b*). Whereas the output of the filtering-type high frequency switching circuit 100 of FIG. 1 starts to lose linearity at −12.3 dBm, as shown in FIG. 4(*b*), the output of the filtering-type high frequency switching circuit 200 of FIG. 3 does not lose its linearity until 9.4 dBm as shown in FIG. 4(*a*). Thus, with the filtering-type high frequency switching circuit 200 in which pull-up potentials are applied, even when a large power is applied there is no distortion in the output.

Third Embodiment

Figure 5:
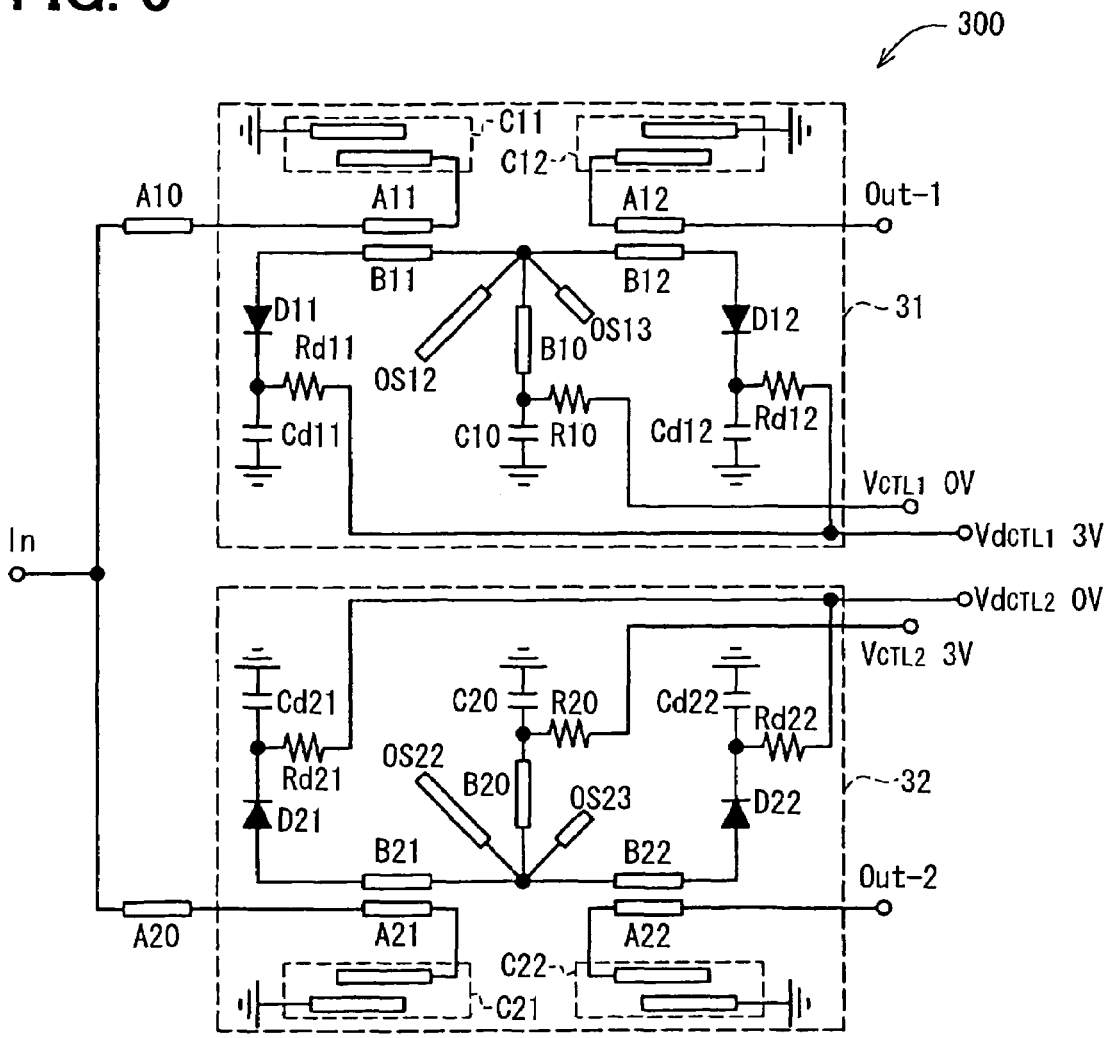
FIG. 5 is a circuit diagram showing the construction of a filtering-type high frequency switching circuit 300 according to a third embodiment of the invention.

FIG. 5 is a circuit diagram showing the construction of a filtering-type high frequency switching circuit 300 according to a third embodiment of the invention. The construction of the filtering-type high frequency switching circuit 300 of FIG. 5 is exactly the same as that of the filtering-type high frequency switching circuit 200 of FIG. 3 except for the parts discussed below, and the parts that are the same have been given the same reference numerals.

The filtering-type high frequency switching circuit 300 of FIG. 5 has, with respect to the filtering-type high frequency switching circuit 200 of FIG. 3, open stubs $OS_{i2}$ *and* $OS_{i3}$ that resonate at the second harmonic wave and second harmonic wave of the center frequency of the band-pass filter connected to the connection point of the lines $B_{i0}$, $B_{i1}$ and $B_{i2}$ (i=1 or 2). The open stubs $OS_{i2}$ *and* $OS_{i3}$ are of lengths corresponding to ¼ of the wavelength of the second harmonic wave and second harmonic wave of the center frequency of the band-pass filter.

Figure 6:
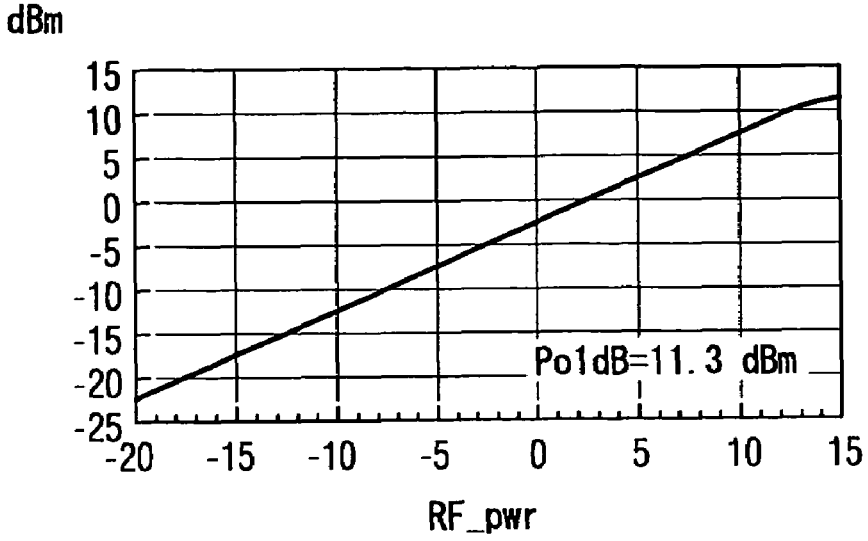
FIG. 6(*a*) is an output characteristic chart of the filtering-type high frequency switching circuit 300, and FIG. 6(*b*) is a frequency characteristic chart of the filtering-type high frequency switching circuit 300.
Figure 6:
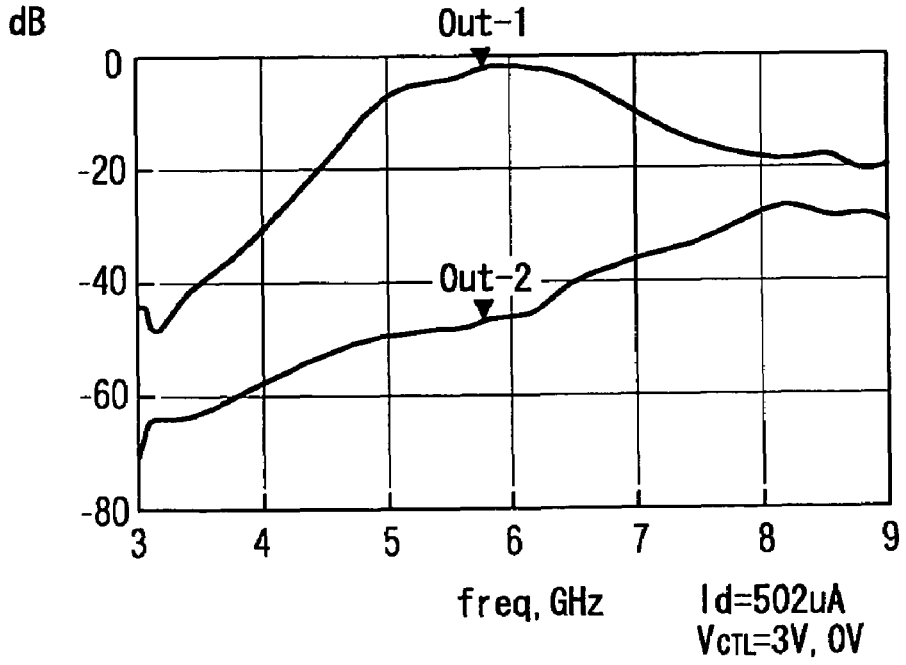

An output characteristic chart of the filtering-type high frequency switching circuit 300 of FIG. 5 is shown in FIG. 6(*a*) and a frequency characteristic chart in FIG. 6(*b*). In both FIGS. 6(*a*) and 6(*b*), characteristics are shown for a case where the voltage control terminal $V_{CTL1}$ was grounded (0V) and 3V was applied to the voltage control terminal $V_{CTL2}$, whereby the switch circuit 11 was turned on (making it function as a band-pass filter) and the switch circuit 12 was turned off (to cut off high frequencies), and also 3V was applied as the pull-up potential $Vd_{CTL1}$ and the pull-up potential $Vd_{CTL2}$ was grounded (0V).

As shown in FIG. 6(*a*), the output of the filtering-type high frequency switching circuit 300 of FIG. 5 does not lose its linearity until 11.3 dBm, and with respect to the 9.4 dBm at which the output of the filtering-type high frequency switching circuit 200 of FIG. 3 loses its linearity (see FIG. 4(*a*)) a further improvement has been achieved. As shown in FIG. 6(*b*), in the frequency characteristics also, at the center frequency 5.8 GHz high frequencies were outputted from the output terminal Out-1 extremely well with a small attenuation of −2.6 dB, and at the output terminal Out-2 the attenuation was large, at −47.2 dB, and high frequencies were extremely well cut off. Thus, with this filtering-type high frequency switching circuit 300 having open stubs $OS_{i2}$ and $OS_{i3}$ that resonate at the second harmonic wave and second harmonic wave of the center frequency of the band-pass filter, it is possible to further improve the power characteristic while keeping the frequency characteristics good.

A brief explanation of the operation of the open stubs $OS_{i2}$ and $OS_{i3}$ resonating at the second harmonic wave and second harmonic wave of the center frequency of the band-pass filter is as follows. With t as time, a Taylor development to the tertiary term of an output y(t) with respect to an input x(t) is as shown by the following Exp. (3).

$$y(t)=\alpha_1 x(t)+\alpha_2\{x(t)\}^2+\alpha_3\{x(t)\}^3 \quad (3)$$

The input x(t) can be defined in terms of an amplitude A and an angular frequency ω as shown in expression (4).

$$x(t)=A\cos(\omega t) \quad (4)$$

Substituting Exp. (4) into Exp. (3) and rearranging gives the following Exp. (5).

$$y(t)=\alpha_2(a)^2/2+(\alpha_1 A+3\alpha_3 A^3/4)\cos(\omega t)+\alpha_2(a)^2\cos(2\omega t)/2+\alpha_3 A^3\cos(3\omega t)/4 \quad (5)$$

The coefficient $\alpha_3$ in the tertiary term of Exp. (3) is a normal load, and in Exp. (5), when the amplitude A of the input x(t) becomes large, the coefficient of the second term, which is the part proportional to the input x(t), becomes small, and displays a saturation phenomenon. In addition to this, the third and fourth terms, which show the secondary and second harmonic waves, also become large. These higher harmonics increase the potential differences across the anodes and cathodes of the diodes in the on-side switch circuit, where properly the potential differences should be eliminated, and increase distortion. To avoid this, by providing two stubs to short out the secondary and second harmonic waves, it is possible to eliminate at least the third and fourth terms of Exp. (5). By this means the power characteristic is improved more than when the two stubs are not provided.

Although in the filtering-type high frequency switching circuit 300 of FIG. 5 open stubs $OS_{i2}$ and $OS_{i3}$ were provided in each of the two switch circuits 31, 32, these may alternatively be formed with capacitors. For example chip capacitors may naturally be used for these capacitors, and the designing of the chip size accordingly is included in the present invention.

Figure 7:
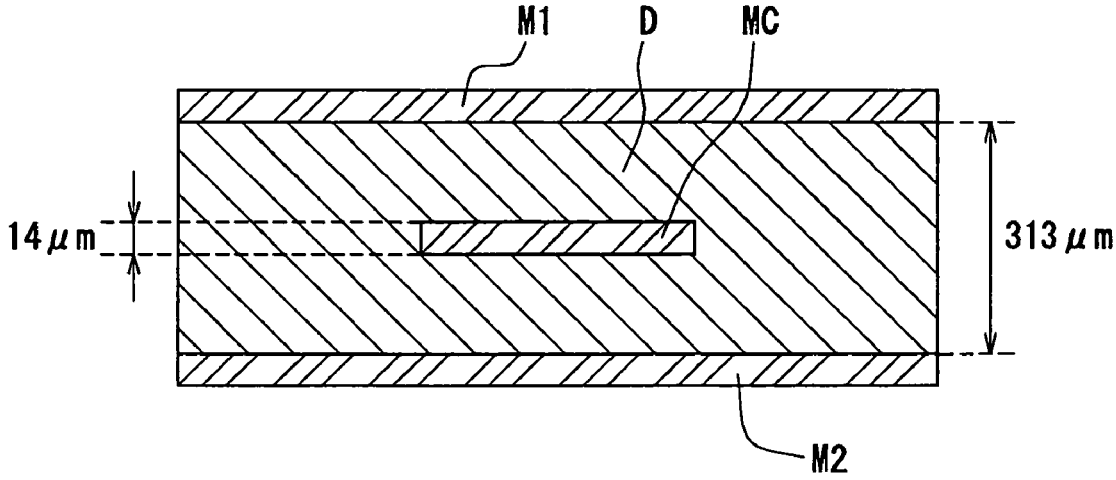
FIG. 7 is a sectional view showing an example of a tn-plate structure.
Figure 8:
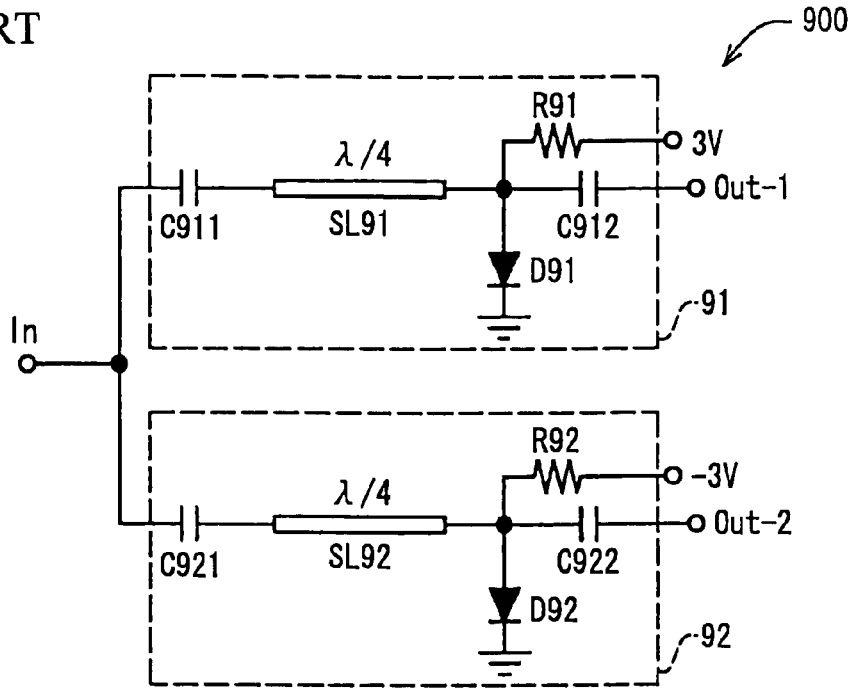
FIG. 8 PRIOR ART
FIG. 8 is a circuit diagram showing a prior art construction of a 1-input, 2-output switch using a diode and a quarter-wavelength slab line.
Figure 9:
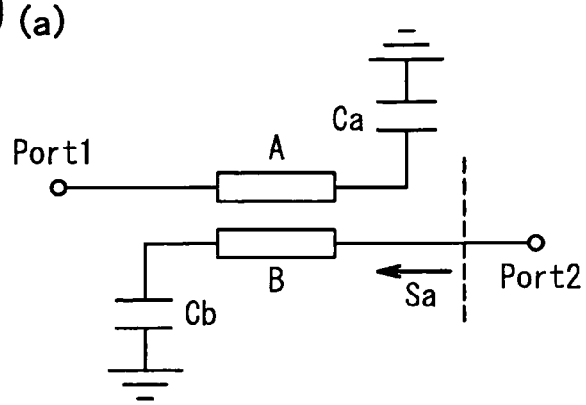
FIGS. 9(*a*) through 9(*c*) are circuit diagrams illustrating a basic construction of the invention.
Figure 9:
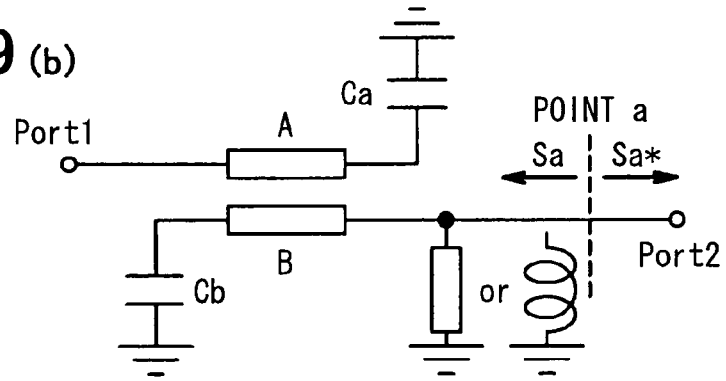
Figure 9:
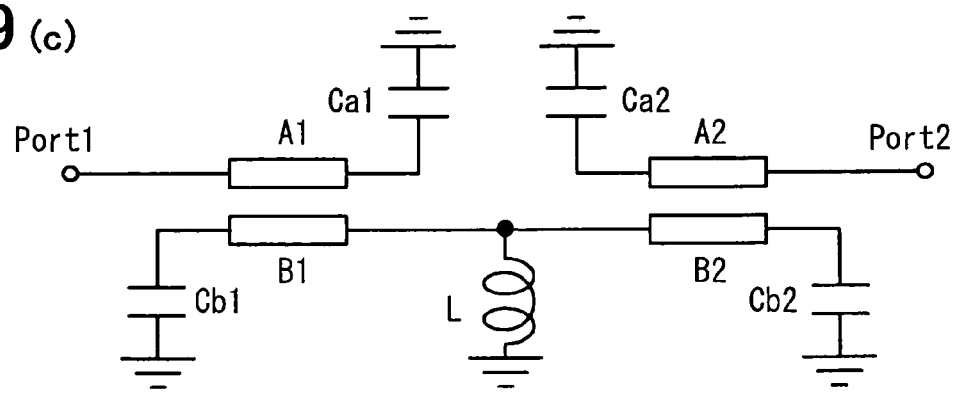
Figure 10:
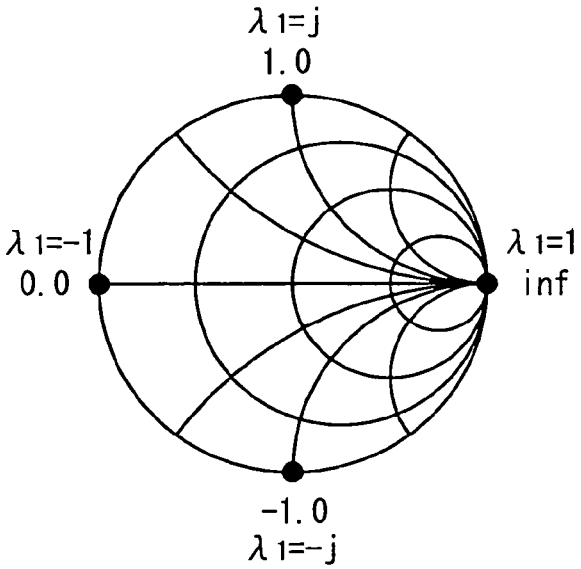
FIGS. 10(*a*) through 10(*c*) are Smith charts illustrating simulation results relating to reflection characteristics of the circuits of FIGS. 9(*a*) through 9(*c*).
Figure 10:
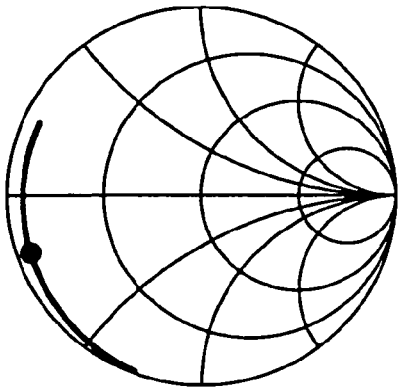
Figure 10:
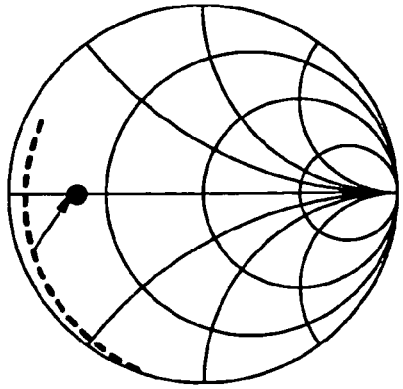
Figure 11:
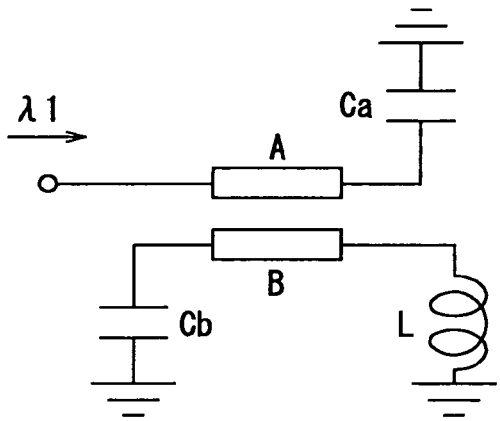
FIG. 11(*a*) is a circuit diagram showing circuit elements effective during even excitation, and FIG. 11(*b*) is a circuit diagram showing circuit elements effective during odd excitation.
Figure 11:
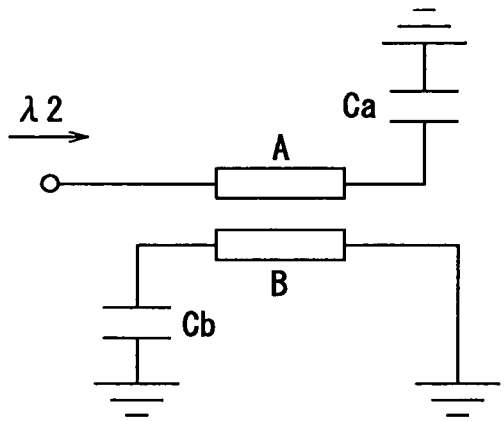
Figure 12:
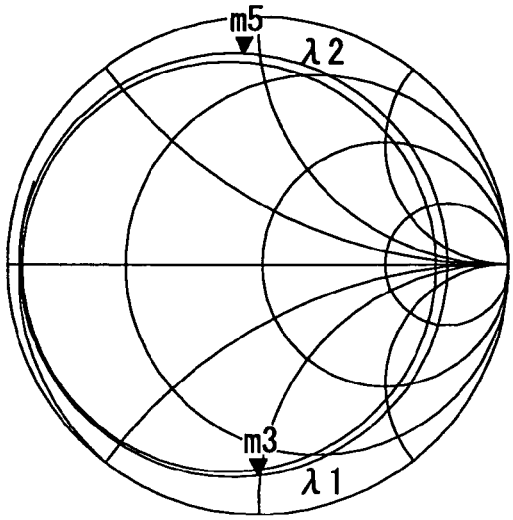
FIG. 12 is a Smith chart showing an effect on reflection characteristic of an inductance component in the circuit of FIG. 11(*b*).
Figure 13:
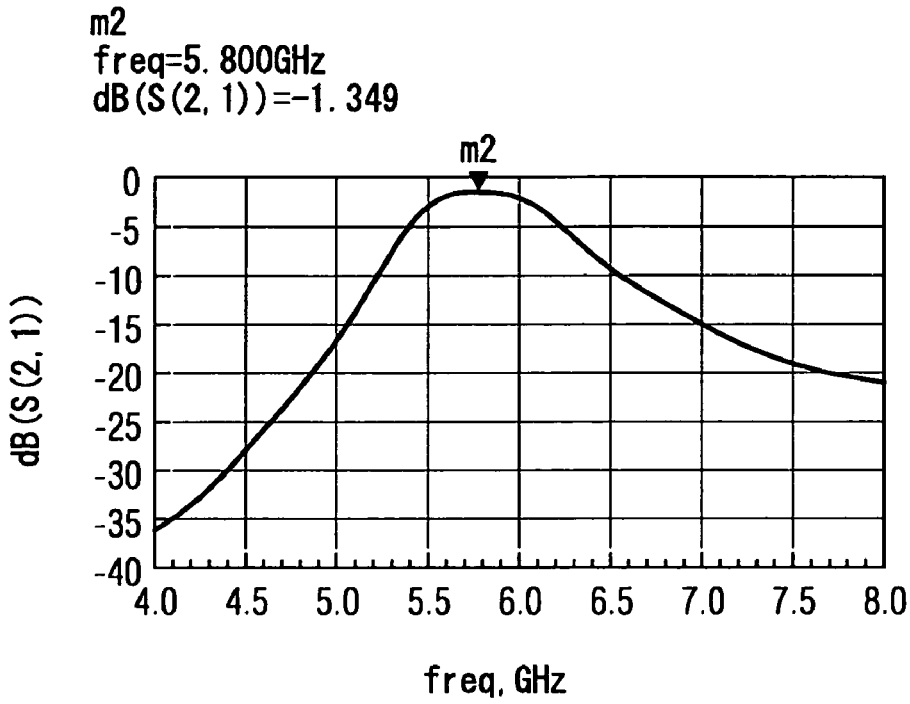
FIG. 13(*a*) is a graph showing the transmittance characteristic of the circuit of FIG. 9(*a*), and FIG. 13(*b*) is a graph showing the reflection characteristic of the circuit shown in FIG. 9(*a*).
Figure 13:
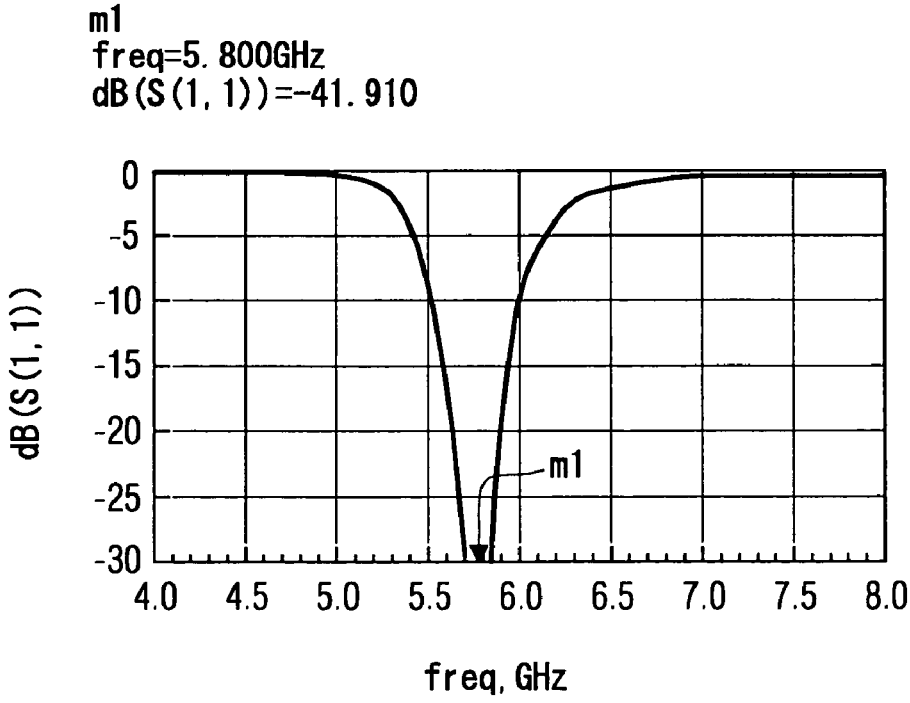

In the embodiments described above, if the line parts are formed as central layers of tri-plate strip lines of a 3-layer construction having grounds as an upper layer and a lower layer of the kind shown in FIG. 7, the merit can be obtained that because these parts are sandwiched by grounds there is no radiation. As the type of the metal used (M1, MC, M2 in FIG. 7), although gold (Au) is superior from the point of view of conductivity, copper, aluminum, or an alloy of these, or a metal made by laminating these can be used. In an embodiment in which an organic substrate D has a relative permittivity of 3.4, the present invention can be implemented with the thickness of the metal MC made 14 μm and the thickness of the organic substrate D between the metals M1 and M2 made 313 μm.

The correspondences between the constituent elements of the foregoing first embodiment and variation thereof, the second embodiment and the third embodiment (hereinafter, the foregoing embodiments) and the items set forth in the scope of the claim are as follows. Using i to represent the constituent devices of either of the two switch circuits without distinguishing which, the lines $A_{i1}$, $B_{i1}$, $B_{i2}$, $A_{i2}$, and $B_{io}$ in the foregoing embodiments correspond to first, second, third, fourth and fifth lines set forth in the claims. Similarly, the diodes $D_{i1}$ and $D_{i2}$ in the foregoing embodiments correspond to 'two diodes,' and the capacitors $C_{i1}$ and $C_{i2}$ in the foregoing embodiments respectively correspond to 'first and second capacitors.' The input terminal In and the output terminals Out-1 and Out-2 in the foregoing embodiments correspond to 'an input terminal' and 'two output terminals.' The open stubs $OS_{i2}$ and $OS_{i3}$ correspond to 'open stubs or capacitors for shorting a second harmonic wave and second harmonic wave'.

Fourth Embodiment

Figure 14:
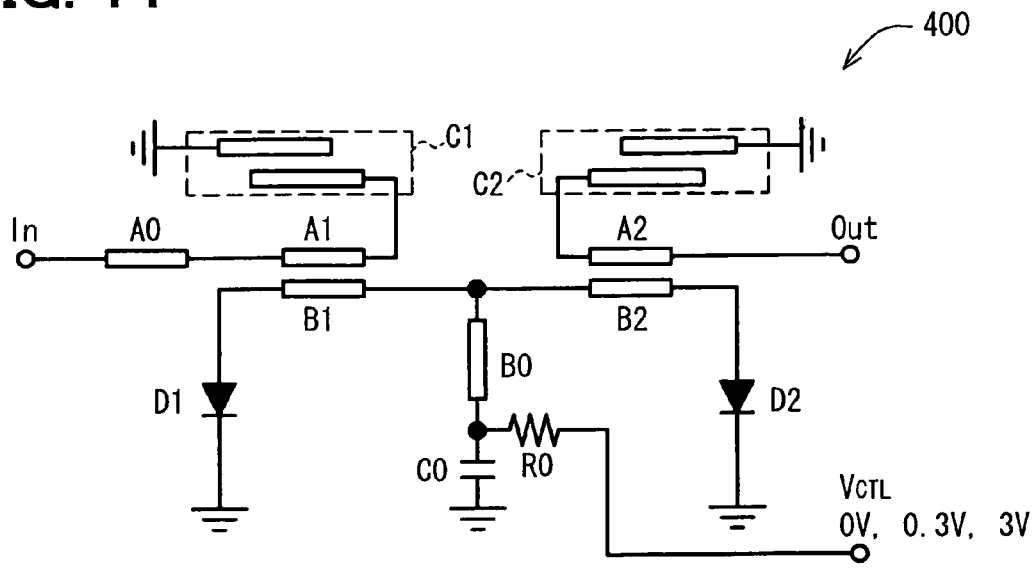
FIG. 14 is a circuit diagram showing the construction of a filtering-type high frequency switching circuit 400 according to a fourth embodiment of the invention.

FIG. 14 is a circuit diagram showing the construction of a filtering-type high frequency switching circuit 400 according to a fourth embodiment of the invention. The filtering-type high frequency switching circuit 400 of FIG. 14 is a half of the construction of the filtering-type high frequency switching circuit 100 of the first embodiment, and the i indicating correspondence with an output terminal Out-i has been removed from the reference numerals. In this embodiment, the first and second diodes are diodes $D_1$, $D_2$ and the third capacitor is a capacitor $C_0$.

Thus, the present invention is not limited to the 1-input, 2-output filtering-type high frequency switching circuit 100, and can also be applied to a 1-input, 1-output filtering-type high frequency switching circuit 400.

The essential constituent elements of the filtering-type high frequency switching circuit 400 are as follows. That is, in a filtering-type high frequency switching circuit having one input terminal In, one output terminal Out and a switch circuit between the input terminal In and the output terminal Out, for passing a high frequency of a desired bandwidth by applying a predetermined potential to a voltage control point of the switch circuit, the switch circuit is made up of a first line $A_1$ having one end electrically connected to the input terminal In and the other end grounded via a first capacitor $C_1$, a second line $B_1$ forming a pair of coupled lines by being at least partly disposed substantially parallel to the first line $A_1$ and having one end connected to the anode of a first diode $D_1$ having its cathode grounded, a third line $B_2$ having one end connected to the other end of the second line $B_1$ and the other end connected to the anode of a second diode $D_2$ having its cathode grounded, a fourth line $A_2$ forming a pair of coupled lines by being at least partly disposed substantially parallel to the third line $B_2$ and having one end electrically connected to the output terminal Out and the other end grounded via a second capacitor $C_2$ and a fifth line $B_0$ having one end connected to the connection point between the second line $B_1$ and the third line $B_2$ and the other end grounded via a third capacitor $C_0$, the first and second capacitors $C_1$, $C_2$, the first and fourth lines $A_1$, $A_2$, the second and third lines $B_1$, $B_2$ and the first and second diodes $D_1$, $D_2$ each having the same device characteristics, the switch circuit being symmetrical about the connection point of the second line $B_1$, the third line $B_2$ and the fifth line $B_0$, and the voltage control point being made between the fifth line $B_0$ and the third capacitor $C_0$ of the switch circuit.

Fifth Embodiment

Figure 15:
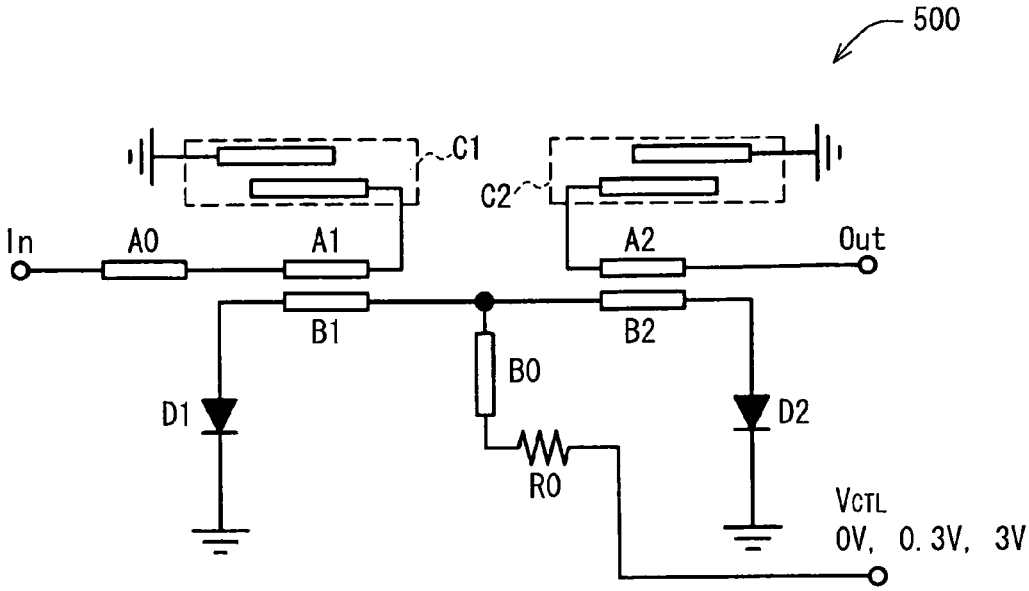
FIG. 15 is a circuit diagram showing the construction of a filtering-type high frequency switching circuit 500 according to a fifth embodiment of the invention.

FIG. 15 is a circuit diagram showing the construction of a filtering-type high frequency switching circuit 500 according to a fifth embodiment of the invention. In this filtering-type high frequency switching circuit 500, as a fifth line $B_0$ corresponding to the fifth line $B_0$ in FIG. 14 an open stub is used.

Specifically, the filtering-type high frequency switching circuit 500 of FIG. 15 is one in which the third capacitor $C_0$ which is grounded is removed from the constituent elements of the filtering-type high frequency switching circuit 400 in FIG. 14. In this case, in the filtering-type high frequency switching circuit 500, the fifth line $B_0$ operates not as an inductor but as a capacitor.

With this construction also, a filtering-type high frequency switching circuit that functions in the same way as the filtering-type high frequency switching circuits of the embodiments described above can be realized.

Sixth Embodiment

Figure 16:
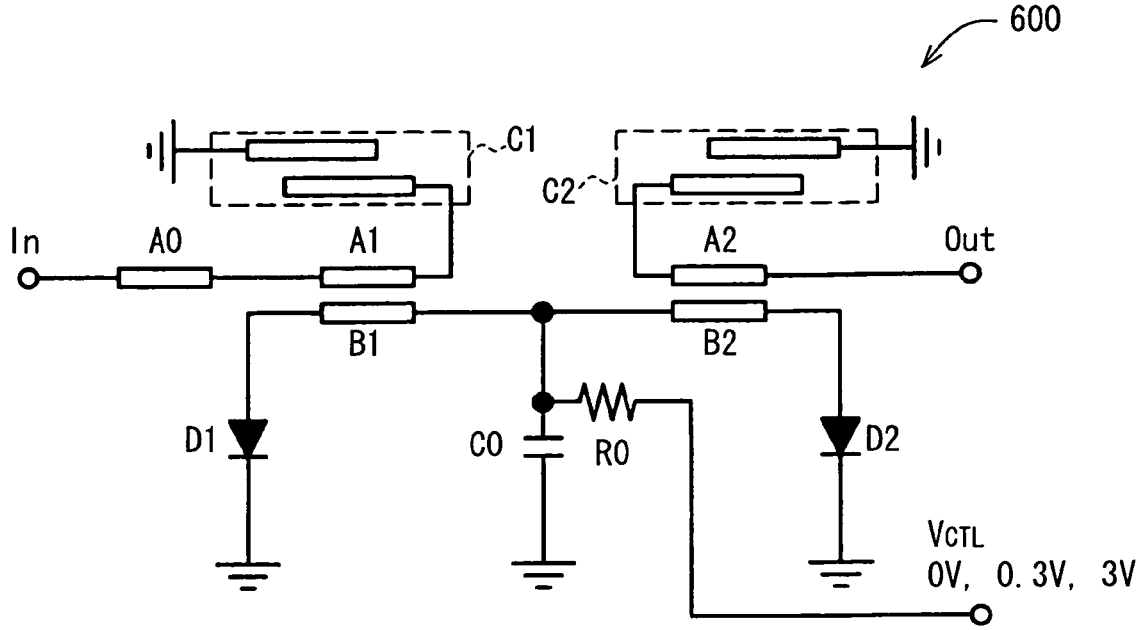
FIG. 16 is a circuit diagram showing the construction of a filtering-type high frequency switching circuit 600 according to a sixth embodiment of the invention.

FIG. 16 is a circuit diagram showing the construction of a filtering-type high frequency switching circuit 600 according to a sixth embodiment of the invention. This filtering-type high frequency switching circuit 600 is obtained from the construction of the filtering-type high frequency switching circuit 400 of FIG. 14 by eliminating the fifth line $B_0$ and making the voltage control point the connection point of the second and third lines $B_1$ and $B_2$ and whereas the capacitor $C_0$ of the filtering-type high frequency switching circuit 400 of FIG. 14 is for simply maintaining potential, the capacitor $C_F$ that here is the third capacitor has its capacitor designed so as to exhibit a filter function.

Filtering-type frequency switches of the kind shown in FIG. 14 through FIG. 16 can be made switches with respect to desired frequencies by any design. That is, it is possible to connect to one input a plurality of switch circuits passing different frequencies to make a one input, multiple output switch outputting desired frequency bands from the output terminals of the different switch circuits. Of course, such individual filtering-type frequency switches constituting a one input, multiple output switches are included in the present invention.

The invention claimed is:

1. A filtering-type high frequency switching circuit having one input terminal, one output terminal, and a switch circuit connected between the input terminal and the output terminal, a potential of at least one location of the switch circuit being made controllable to pass or cut off a high frequency of a desired bandwidth, the filtering-type frequency switch circuit comprising:

a first line having one end electrically connected to the input terminal and the other end connected to a first potential via a first capacitor;

a second line forming a pair of coupled lines by being at least partly disposed substantially parallel to the first line, and having one end connected to one end of a first diode, the first diode having its other end connected to a second potential;

a third line having one end connected to the other end of the second line and the other end connected to one end of a second diode having as its other end the same pole as the first diode connected to the second potential;

a fourth line forming a pair of coupled lines by being at least partly disposed substantially parallel to the third line and having one end electrically connected to the output terminal and the other end connected to a third potential via a second capacitor; and a fifth line having one end connected to a connection point between the second line and the third line and the other end connected to a fourth potential, wherein the first and second capacitors, the first and fourth lines, the second and third lines and the first and second diodes respectively have the same device characteristics to each other, wherein the switch circuit is symmetrical about a connection point among the second line, the third line and the fifth line, and wherein the controllable potential is at least one of the second potential and the fourth potential.

2. The filtering-type high frequency switching circuit as in claim 1, further comprising:

an open stub or a capacitor, for shorting a second harmonic wave of the high frequency that is the center frequency of the band being passed; and an open stub or a capacitor, provided at the point of connection among the second line, the third line and the fifth line, for similarly shorting a third harmonic wave.

3. The filtering-type high frequency switching circuit as in claim 1, wherein the fifth line comprises an inductor.

4. The filtering-type high frequengy switching circuit in claim 2, wherein an inductor is provided in place of the fifth line.

5. A filtering-type high frequency switching circuit having one input terminal, two output terminals, and switch circuits having the same construction and connected between the input terminal and the two output terminals, a potential of at least one location of each of the two switch circuits being made controllable so that at least one of the switch circuits passes or cuts off a high frequency of a desired bandwidth, each of the two switch circuits comprising:

a first line having one end electrically connected to the input terminal and the other end connected to a first potential via a first capacitor;

a second line forming a pair of coupled lines by being at least partly disposed substantially parallel to the first line, and having one end connected to one end of a first diode, the first diode having its other end connected to a second potential;

a third line having one end connected to the other end of the second line and the other end connected to one end of a second diode having as its other end the same pole as the first diode connected to the second potential;

a fourth line forming a pair of coupled lines by being at least partly disposed substantially parallel to the third line and having one end electrically connected to one of the output terminals and the other end connected to a third potential via a second capacitor; and a fifth line having one end connected to a connection point between the second line and the third line and the other end connected to a fourth potential, wherein the first and second capacitors, the first and fourth lines, the second and third lines and the first and second diodes respectively have the same device characteristics to each other, wherein each of the two switch circuits is symmetrical about a connection point among the second line, the third line and the fifth line, and wherein the controllable potential is at least one of the second potential and the fourth potential.

6. The filtering-type high frequency switching circuit as in claim 5, wherein:

a potential difference between the second potential and the third potential is zero or a reverse bias in one of the two switch circuits; and the potential difference between the second potential and the third potential is a forward potential difference in a range such that no current flows through the first and the second diodes in the other of the two switch circuits.

7. The filtering-type high frequency switching circuit as in claim 5, wherein:

a potential difference between the second potential and the third potential is a reverse bias and larger than a voltage amplitude of a high frequency wave inputted through the input terminal in one of the two switch circuits; and the potential difference between the second potential and the third potential is a forward potential difference in a range such that a current flows to the first and the second diodes and larger than the voltage amplitude of the high frequency wave inputted through the input terminal in the other of the two switch circuits.

8. The filtering-type high frequency switching circuit as in claim 5, further comprising:

an open stub or a capacitor, for shorting a second harmonic wave of the high frequency that is the center frequency of the band being passed; and an open stub or a capacitor, provided at the point of connection among the second line, the third line and the fifth line, for similarly shorting a third harmonic wave.

9. The filtering-type high frequency switching circuit as in claim 6, further comprising:

an open stub or a capacitor, for shorting a second harmonic wave of the high frequency that is the center frequency of the band being passed; and an open stub or a capacitor, provided at the point of connection among the second line, the third line and the fifth line, for similarly shorting a third harmonic wave.

10. The filtering-type high frequency switching circuit as in claim 7, further comprising:

an open stub or a capacitor, for shorting a second harmonic wave of the high frequency that is the center frequency of the band being passed; and an open stub or a capacitor, provided at the point of connection among the second line, the third line and the fifth line, for similarly shorting a third harmonic wave.

11. The filtering-type high frequency switching circuit as in claim 2, wherein an inductor is provided in place of the fifth line.

12. The filtering-type high frequency switching circuit as in claim 6, wherein an inductor is provided in place of the fifth line.

13. The filtering-type high frequency switching circuit in claim 4, wherein an inductor is provided in place of the fifth line.

* * * * *